US008917883B2

(12) United States Patent
Poulsen et al.

(10) Patent No.: US 8,917,883 B2
(45) Date of Patent: Dec. 23, 2014

(54) ELECTRONIC DEVICE AND AUDIO ACCESSORY HAVING A PLURALITY OF PASSIVE SWITCHES FOR CONTROLLING THE AUDIO DEVICE

(75) Inventors: Jens Kristian Poulsen, Kitchener (CA); Cyril Antoine Martin, Dusseldorf (DE); Mohamad El-Hage, Cambridge (CA)

(73) Assignee: Blackberry Limited, Waterloo (CA)

( * ) Notice: Subject to any disclaimer, the term of this patent is extended or adjusted under 35 U.S.C. 154(b) by 831 days.

(21) Appl. No.: 13/049,732

(22) Filed: Mar. 16, 2011

(65) Prior Publication Data

US 2012/0237044 A1 Sep. 20, 2012

(51) Int. Cl.

| | |
|---|---|
| ***H04R 3/00*** | (2006.01) |
| ***H04R 27/00*** | (2006.01) |
| ***H04R 1/10*** | (2006.01) |
| *H04R 5/033* | (2006.01) |

(52) U.S. Cl.

CPC ..... *H04R 1/1041* (2013.01); *H04R 5/033* (2013.01)

USPC ..... 381/81; 381/85

(58) Field of Classification Search

CPC ..... H04R 1/104; H04R 5/033

USPC ..... 381/74, 81, 123, 113, 384

See application file for complete search history.

(56) References Cited

U.S. PATENT DOCUMENTS

| | | | | |
|---|---|---|---|---|
| 7,916,875 | B2 * | 3/2011 | Kanji | 381/58 |
| 8,064,613 | B1 * | 11/2011 | Helfrich | 381/74 |
| 2007/0281744 | A1 * | 12/2007 | Andreasson | 455/557 |
| 2008/0032753 | A1 | 2/2008 | Nho | |
| 2009/0179768 | A1 | 7/2009 | Sander et al. | |
| 2011/0057711 | A1 | 3/2011 | Hung et al. | |

FOREIGN PATENT DOCUMENTS

| | | |
|---|---|---|
| EP | 1156587 | 11/2001 |

OTHER PUBLICATIONS

European Patent Office, Extended European Search Report, for European Patent Application Serial No. 11158471.0, mailed Sep. 2, 2011.

Hanna Moore & Curley, Response to Extended European Search Report, for European Patent Application Serial No. 11158471.0 dated Mar. 19, 2013.

European Patent Office, Notice of Intent to Grant, for European Patent Application Serial No. 11158471.0 dated Apr. 18, 2013.

Korean Patent Office, Office Action for Korean Patent Application Serial No. 10-2012-0027380, mailed Jun. 21, 2013.

English Translation of Office Action for Korean Patent Application Serial No. 10-2012-0027380, mailed Jun. 21, 2013.

* cited by examiner

*Primary Examiner* — Fan Tsang
*Assistant Examiner* — Eugene Zhao
(74) *Attorney, Agent, or Firm* — Novak Druce Connolly Bove + Quigg LLP

(57) ABSTRACT

According to some aspects, a system for controlling an electronic device including an audio accessory coupled to the electronic device. The audio accessory has at least one speaker adapted to provide audio output and a plurality of resistive switches. The electronic device has a bias voltage source adapted to provide power to the resistive switches via a bias resistor and a ground connection, and a measurement module. The measurement module is adapted to monitor a bias point to determine which of the at least one switch has been engaged based on effect of the resistive switches on the ground offset voltage after compensating for a ground offset voltage caused by the audio output.

20 Claims, 6 Drawing Sheets

ELECTRONIC DEVICE AND AUDIO ACCESSORY HAVING A PLURALITY OF PASSIVE SWITCHES FOR CONTROLLING THE AUDIO DEVICE

FIELD

The embodiments described herein relate to electronic devices and audio accessories, such as audio devices and headphones, and in particular to control switches provided on such audio accessories for controlling the electronic devices.

INTRODUCTION

Electronic devices, including portable electronic devices, have gained widespread use and may provide a variety of functions including audio and video playback, telephonic, electronic text messaging and other personal information manager (PIM) application functions. Portable electronic devices can include several types of devices, including for example cellular phones, smart phones, Personal Digital Assistants (PDAs), music players, portable televisions or DVD players, tablets and laptop computers. Many of these devices are handheld, that is, sized and shaped to be held or carried in a human hand. Electronic devices are often used with audio accessories, such as headsets. For example, electronic devices often have audio jacks (or sockets) that are sized and shaped to receive a mating plug from a headset. A user may connect the headset to the electronic device by inserting the plug on the headset into the audio jack on the electronic device. In some electronic devices, headsets may incorporate a microphone to allow audio signals (e.g., speech) to be sent from the accessory to the electronic device. This may allow the user to make phone calls through the accessory, record voice memos, and so on.

BRIEF DESCRIPTION OF THE DRAWINGS

Embodiments of the present disclosure will now be described, by way of example only, with reference to the attached figures, in which.

DETAILED DESCRIPTION

Figure 1:
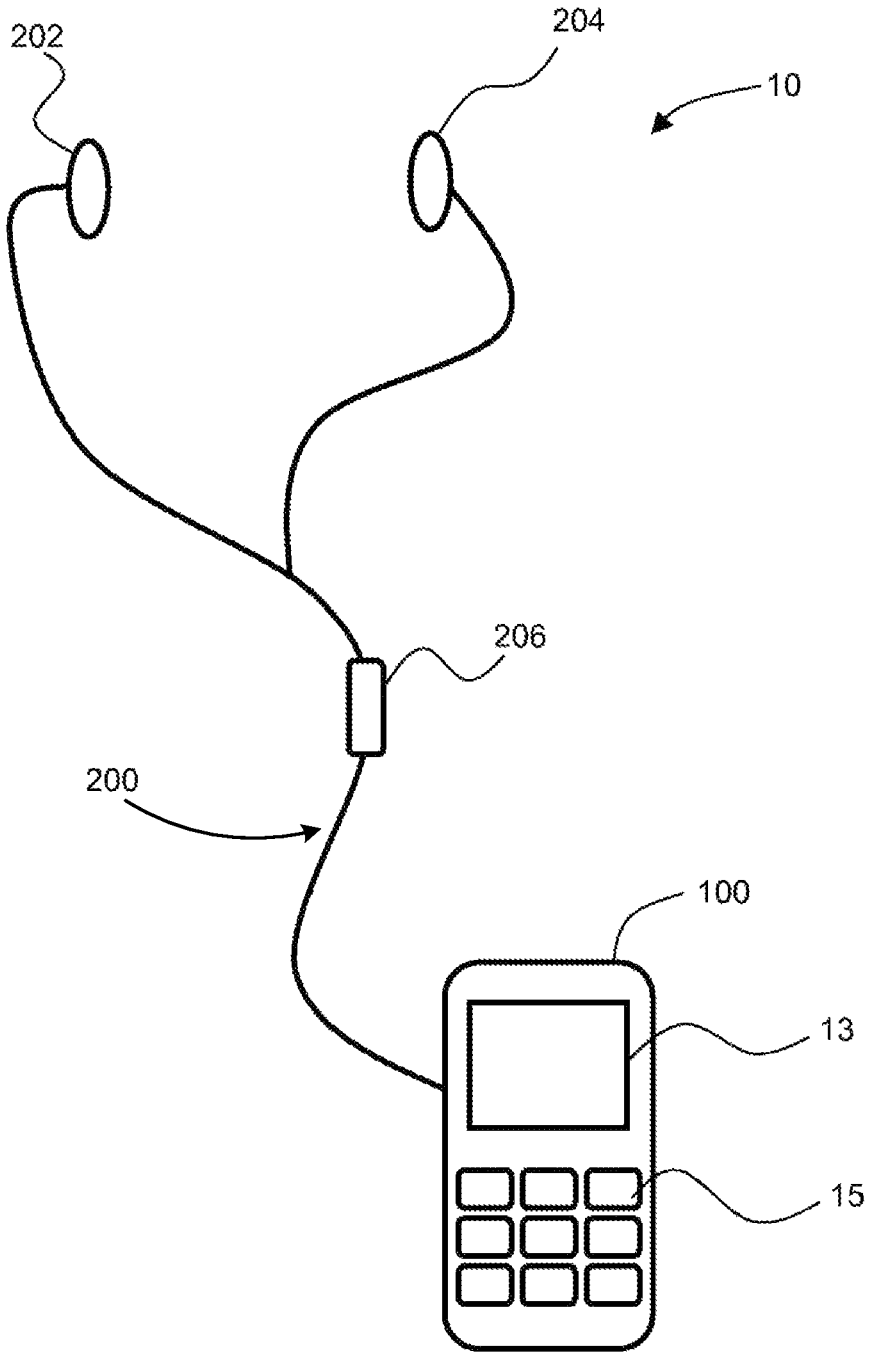
FIG. 1 is a schematic diagram of an audio system including a portable electronic device and an audio accessory according to some embodiments.

There are many kinds of electronic devices for which audio accessories, such as headsets, may provide convenience to a user. Many users prefer headsets that are lightweight and that are relatively robust. A user may connect such a headset to the electronic device by inserting a plug on the headset into an audio jack on the electronic device. Once a proper connection is made between the jack and the plug, the audio output to the speaker(s) of the headset can be controlled by via controls on the electronic device, or by controls on the headset accessory, or both. Where there are controls on the headset, there may be advantages to making the controls lightweight and robust. In some implementations, these benefits may be realized is by making the controls on the headset comparatively simple, such that the user may manipulate the controls on the headset to generate commands. The electronic device recognizes the commands and carries them out. In other words, the user issues commands to the electronic device through controls on the headset.

In conventional headsets with controls, there may be challenges associated with generating, and having the electronic device recognize, multiple commands. A conventional headset that has (for example) three distinct command buttons or keys may use simple resistors to distinguish between different key presses. A different resistor is switched into the circuit depending upon which key is pressed. Because the electrical currents in the headset (such as current to a microphone) are not known with precision, and because of other practical considerations, it may be difficult to implement more than three keys reliably. Some conventional headsets employ an active scheme in which the headset has its own signal generator (and often its own power supply), but such approaches give up some simplicity and robustness (and may also be more expensive). The concepts described herein can enable an accessory such as a headset to provide multiple commands, and the command will be recognizable to an electronic device, without the need for a signal generator or power supply (although the concepts described herein can also work with a signal generator or power supply).

According to one aspect, there is provided a system for controlling an electronic device comprising an audio accessory coupled to the electronic device, the audio accessory having at least one speaker for providing audio output and a plurality of resistive switches, each switch having a selected resistance, and the electronic device having a bias voltage source for providing power to the resistive switches via a bias resistor and a ground connection, and a measurement module. The measurement module is adapted to monitor a bias point on a connection between the bias voltage source and the resistive switches to determine when at least one of the switches has been engaged, at least once while that switch is engaged, activate and deactivate the bias voltage source, taking a first measurement of the bias point while the bias voltage source is activated and a second measurement of the electrical connection while the bias voltage source is deactivated, determine an ground offset voltage caused by the audio output based on the second measurement, compensate for the ground offset voltage caused by the audio output based on a voltage difference between the first and second measurements, and determine which of switches has been engaged based on the voltage difference.

According to another aspect, there is provided an audio accessory comprising at least one speaker for providing audio output and a plurality of resistive switches, each switch having a selected resistance, the audio accessory being coupleable to an electronic device having a bias voltage source for providing power to the resistive switches via an bias resistor, and a measurement module. In addition, when the audio accessory is coupled to the electronic device, the measurement module is adapted to monitor a bias point on a connection between the bias voltage source and the resistive switches to determine when at least one of the switches has been engaged, at least once while that switch is engaged, activate and deactivate the bias voltage source, taking a first measurement of the electrical connection while the bias voltage source is activated and a second measurement of the electrical connection while the bias voltage source is deactivated, determine a ground offset voltage caused by the audio output based on the second measurement, compensate for the ground offset voltage caused by the audio output voltage based on a voltage difference between the first and second measurements, and determine which of switches has been engaged based on the voltage difference.

According to another aspect there is provided an electronic device coupleable to an audio accessory having at least one speaker for providing audio output and a plurality of resistive switches, each switch having a selected resistance. The electronic device comprises a bias voltage source for providing power to the resistive switches via a bias resistor when the electronic device is coupled to the audio accessory, and a measurement module adapted to monitor a bias point on a connection between the bias voltage source and the resistive switches to determine when at least one of the switches has been engaged, at least once while that switch is engaged, activate and deactivate the bias voltage source, taking a first measurement of the electrical connection while the bias voltage source is activated and a second measurement of the electrical connection while the bias voltage source is deactivated, determine a ground offset voltage caused by the audio output based on the second measurement, compensate for the ground offset voltage caused by the audio output by determining a voltage difference between the first and second measurements, and determine which of switches has been engaged based on the voltage difference.

According to another aspect, there is provided a method for determining which of a plurality of switches in an audio accessory is engaged comprising providing the audio accessory having at least one speaker for providing audio output and a plurality of resistive switches, each switch having a selected resistance, providing an electronic device coupled to the audio accessory having a bias voltage source for providing power to the resistive switches via a microphone bias resistor and a ground connection, monitoring a bias point on a connection between the bias voltage source and the switches to determine when at least one of the switches has been engaged, at least once while that switch is engaged, activating and deactivating the bias voltage source and taking a first measurement of the electrical connection while the microphone bias voltage source is activated and a second measurement of the electrical connection while the microphone bias voltage source is deactivated, determining a ground offset caused by the audio output, compensating for the ground offset caused by the audio output based on a voltage difference between the first and second measurements, and determining which of the switches has been engaged based on the voltage difference.

Generally, some embodiments as described herein may be implemented on one or more electronic devices, which may include a wide range of devices, such as mobile phones, smart phones, personal digital assistants (PDAs), personal or desktop computers, notebooks, laptops, digital audio/video players, digital audio/video recorders, tablet computers, and so on.

On some of these electronic devices, particular computer resources (e.g., memory capacity, processing power and screen space) may be more limited than on other devices. A portable smart phone, for example, may have a smaller display and less memory capacity than a personal computer, which may have a larger display and more memory. However, the concepts as described herein are not limited to any particular kind of electronic device, but are generally suitable for use on various electronic devices with various computer resources.

In some embodiments, the electronic device may be a portable electronic device, such as a smart phone or personal digital assistant (PDA), and which may have voice communication capabilities, data communication capabilities, or both, over one or more wired connections or a wireless connection.

In some embodiments, the electronic device provide audio and/or video playback, through a display on the device and a speaker on the device or on the audio accessory.

Generally, as already discussed, some audio accessories (e.g., headsets) include command buttons or keys to control some aspects of the electronic device they are connected to. (Examples of controllable aspects may include, but are not limited to, playing, pausing, skipping forward, going backward, changing volume, or muting). The command buttons may permit the user to control the electronic device without needing to interact directly with the electronic device. In some cases, to implement such command buttons, an active signalling system or a passive signalling system between the electronic device and the audio accessory may be used.

Generally, an active signalling system typically requires a chip including electronic logic components to be provided on the accessory, which increases the cost of the headset. The active signalling system may also require a power source on the headset, which may further increase the cost and complexity, and may limit the lifetime of the headset (e.g., where the power source is a battery).

Passive signalling systems, on the other hand, generally do not include a chip or other complex electronic components on the accessory, but may instead use resistive switches. Such passive signalling systems are implemented by analyzing the currents being provided by the electronic device to the audio accessory for operations of some components (e.g., speakers, microphone) of the audio accessory. As such, the passive systems are vulnerable to variations in voltage of the currents. In particular, due to voltage variations caused by audio output through speakers on the accessory, voltage offset across a connection to the ground can be highly variable.

As used herein, "ground" generally refers to a reference voltage with respect to which other voltages are measured or a node at that reference voltage. When two devices, such as an electronic device and an accessory, are electrically connected, they may share a common reference voltage. The reference voltage may be, but need not be, earth potential. Ground potential need not be constant relative to earth potential. The term ground is also used herein with respect to a ground connection, which is typically close to ground potential, and which will be further discussed when the concept of ground offset voltage is addressed. Further, as used herein, "connect" may refer to a mechanical coupling or connection, an electrical connection, or both, according to context. Two components may be electrically connected when the electrical activity of one affects the electrical activity of the other, and the components may be but need not be mechanically connected or proximate.

The accessory may include a microphone that is connected in parallel with one or more resistive switches. The microphone may contain (for example) an internal junction gate field-effect transistor (JFET). The JFET in the microphone generally has large variations in impedance associated therewith for different bias conditions. These variations also contribute to the overall variations in the voltage offset across the ground connection. Voltage variations may also be induced by components that are used to measure the voltage of a particular connection. For example, an analog-to-digital converter (ADC) or a comparator may misread the voltage of the connection due to inherent hardware limitations.

Furthermore, production variations in components and variations in operating conditions (e.g., operating temperature/operating environment) may compound the challenges. These variations in voltage on the accessory may make it difficult to accurately differentiate which switches have been activated (e.g., by a user) based on the overall voltage of the accessory. One approach is to use only a limited number of resistive switches with large differences between the resistances. However, this greatly limits the number of command buttons that can be implemented, and in some such embodiments only two command buttons can be used to accommodate variations in the voltage on the accessory. As noted above, a typical number of controllable aspects is greater than two.

Reference is now made to FIG. 1, which is a schematic diagram illustrating an audio system 10 having an electronic device 100 and an accessory 200 operable for controlling one or more aspects of the electronic device 100 according to some embodiments. As shown, the accessory 200 may be a headset having one or more speakers 202, 204 (also indicated as 16, 18) and a user control interface 206 for receiving one or more user inputs for controlling one or more aspects of the electronic device 100 (although in other embodiments other accessories could be used). The speakers 202, 204 of the headset accessory 200 are generally operable to output audio content, such as music, speech, and so on.

The electronic device 100 could be any suitable electronic device, such as a smart phone having a display 13 and keyboard 15 (as shown), a tablet computer, a media device, and so on. The electronic device 100 may be readily portable, and may be handheld.

The headset accessory 200 as shown is a stereo headset device with left and right audio channels through left and right earphones or ear buds. In other embodiments, the headset accessory 200 may be of different form. For example, the headset accessory 200 may be a mono earphone with just one ear bud, or with two ear buds that receive the same audio output.

Each of the speakers 202 and 204 is operable to provide audio output, for example, audio output generated by the electronic device 100. This allows the user of the headset accessory 200 to listen to the audio output generated by the portable electronic device 100, which could include a phone conversation, music, or any other type of audio output.

Figure 2:
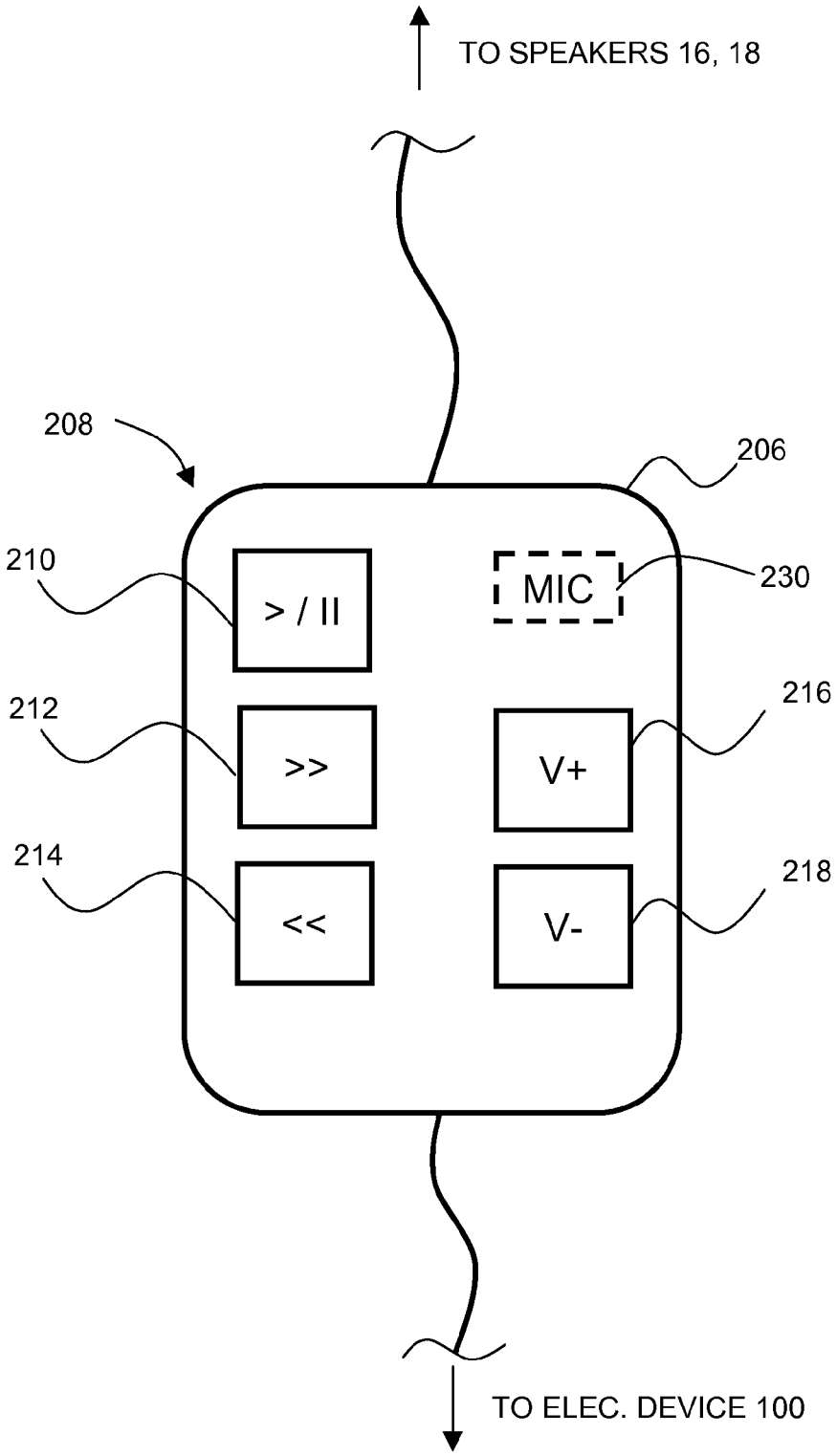
FIG. 2 is a schematic diagram of a controller of the audio accessory shown in FIG. 1.

As shown in FIG. 2, the user control interface 206 may include one or more buttons as generally indicated by the reference numeral 208. In the embodiment as shown, there are five buttons 208, namely, a PLAY/PAUSE button 210, a SKIP/FORWARD button 212, a BACK button 214, a VOLUME INCREASE button 216 and a VOLUME DECREASE button 218.

The number of buttons 208 on the headset accessory 200 may differ in other embodiments. In some embodiments, the headset accessory 200 may include at least three control buttons 208. In some embodiments, the headset accessory 200 may include at least four control buttons 208. In some embodiments, the headset accessory 200 may include up to seven control buttons 208. Further, the placement of the user control interface 206 shown in FIG. 2, interposed between the speakers 16, 18 and the electronic device 100, is merely illustrative.

Having the control buttons 208 on the headset accessory 200 may be desirable as they allow the user to control certain functions of the portable device 100 without needing to directly interact with the portable device 100, which allows remote control of the electronic device 100. For example, the user is able to control the electronic device 100 through the headset accessory 200 even when the device is stored in a purse or a pocket. In some embodiments, the portable device may be in a power saving state (e.g., some components such as the screen 15 is unpowered) to conserve energy and issuing the desired command through the control buttons 208 may allow the portable device to remain in that state while issuing the desired command.

In some embodiments, the PLAY/PAUSE button 210 is operable to send a command to the portable electronic device 100 to start playing an audio track if it is not already playing, of if the audio track is already playing, to pause the playback of the audio track. The PLAY/PAUSE button 210 may also function as a MUTE button when the device 100 is operating as a telephone during a phone conversation.

The SKIP/FORWARD button 212 is operable to send a command to the portable electronic device 100 to skip to the next track. In some embodiments, if the button 212 is held down for a predefined amount of time (e.g., more than 1 second) then the button may signal the device 100 to fast forward within the same track while the button 212 is being held down.

The BACK/REWIND button 214 may function in the opposite manner as the SKIP/FORWARD button 212. That is, the BACK/REWIND button 214 is operable to send a command to the portable electronic device 100 to return to the previous audio track (or to the beginning of the current audio track). In some embodiments, if the button 214 is held down for a predefined amount of time (e.g., more than 1 second) then the button may signal the device 100 to rewind within the same track while the button 214 is being held down.

The VOLUME INCREASE and DECREASE buttons 216 and 218 can be used to send commands to the portable electronic device to increase or decrease the volume of the audio respectively. Similarly, a continuous button press for longer than a predefined amount of time may result in the volume to continue to increase or decrease until the button has been released or the system limits has been reached.

In other embodiments, each of the buttons 208 may perform different (or additional) functionalities.

In some embodiments, the accessory 200 may include a microphone 230 for receiving audio signals (e.g., speech signals from a user) and for sending those audio signals to the electronic device 100. As shown, the microphone 230 may be provided at or with the user control interface 206. Alternatively, the microphone 230 may be provided at another location on the accessory 200. The microphone 230 may be used, for example, if the user is having a conversation through the portable device 100, or if a user is attempting to issue a voice operated command to the portable device 100.

In some embodiments, the headset accessory 200 is connected (mechanically and electrically) to the electronic device 100 using a conventional audio connector plug (on the accessory 200) coupled to a corresponding audio jack/connection port (on the electronic device 100). In some embodiments, the plug and jack can be of the tip-ring-sleeve (TRS) variety, or a tip-ring-ring-sleeve (TRRS) variety, or other various types as are known in the art. For example, some audio connectors are in the form of 3.5 mm (⅛") miniature plugs and jacks, or other sizes such as 2.5 mm connectors and ¼" connectors. In headsets and other accessories, these audio connectors are generally used to carry analog signals between the speakers 202, 204, the microphone 230 and the electronic device 100. Generally, in a TRRS connector, the connection positions on the connector may be referred to as "TIP", "RING 1", "RING 2", and "SLEEVE".

In some embodiments, the connection port of the electronic device is able to switch a ground connection between the "RING 2" position and the "SLEEVE" position such that the electronic device is able to receive the audio accessory having the audio connector with the ground connection located at least one of the "RING 2" position and the "SLEEVE" position. This allows the electronic device to be compatible with audio accessories having audio connectors with different ground configurations.

When the user provides one or more inputs to the accessory 200 using the user control interface 206 (e.g., by pressing one or more of the buttons 210, 212, 214, 216, and 218), the electronic device 100 is operable to recognize the particular button-press, as explained herein below, and take an appropriate action (e.g., increase or decrease volume of audio being output by the speakers 16, 18, answer an incoming telephone call, etc.).

To implement control buttons such as the control buttons 208, simple passive resistors in resistive switches on the circuit boards of audio accessories may be used. However (as indicated previously), it can be difficult to support more than two or three control buttons 208 when using simple resistive switches due to variations of the voltage induced on a ground line due to the current through the speakers (e.g., due to music playing through the speakers) as well as the variations of the current through the microphone's internal JFET and other factors as explained herein above.

Figure 3:
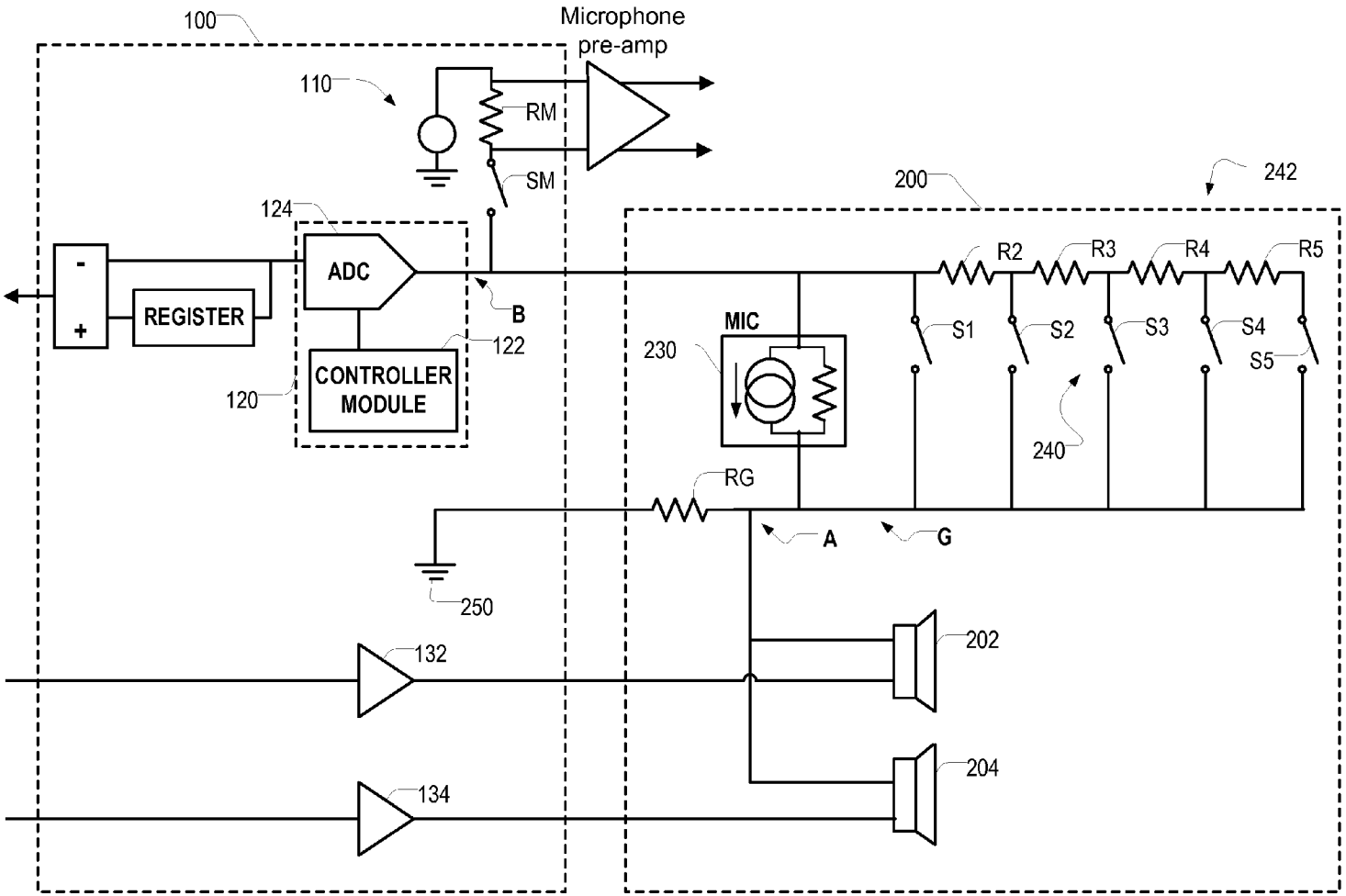
FIG. 3 is a block diagram of components of the electronic device and audio accessory shown in FIG. 1.
Figure 4:
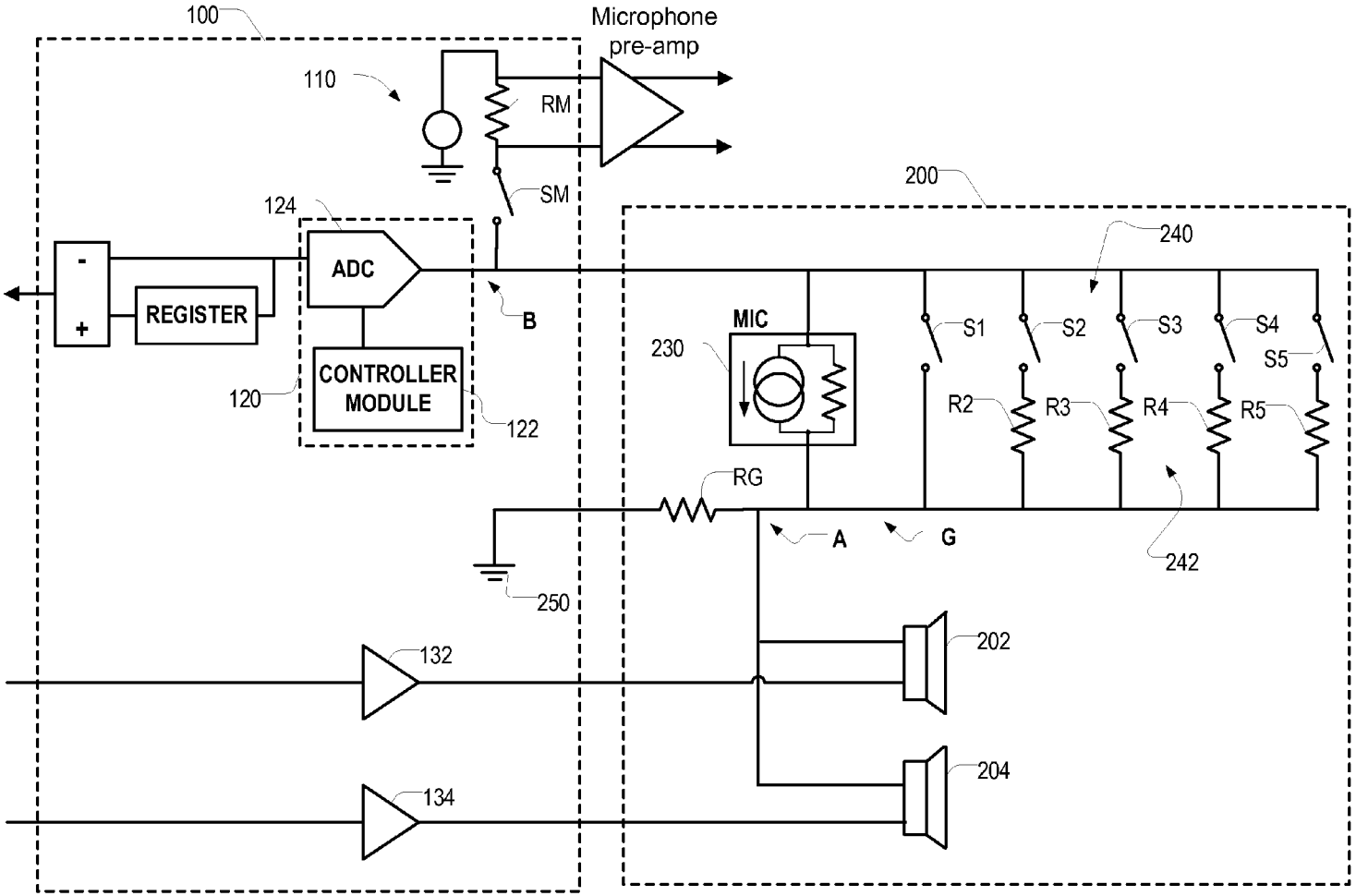
FIG. 4 is a block diagram of components of the electronic device and audio accessory shown in FIG. 1 according to another embodiment.

Referring now to FIGS. 3 and 4, illustrated in each figure is a simplified schematic diagram of some components of audio system 10 according to some embodiments that may be used to provide the control buttons 208 using resistive switches.

As shown, the headset accessory 200 has five resistive switches. (which may be modelled as an ideal coupling switch and a resistive element) The resistive switches are implemented by coupling switches, namely S1, S2, S3, S4 and S5 with some resistive elements 242. As shown, four resistive elements 242, namely, R2, R3, R4, R5 (which may be actual resistors, and which for convenience may be referred to as resistors) are coupled to switches S2, S3, S4 and S5. Note that switch S1 is not associated with any resistors 242 (in other words, no distinct resistive element R1 is depicted), which indicates that the resistive element associated with S1 is small or negligible. In other words, positive current approaching S1 from the left side of the circuit need not pass through any resistor 242 but may still encounter resistance inherent in the connection itself. In contrast, current through S2 would pass through R2, current through S3 would pass through R2 and R3, and so on. For convenience, it may be said that S2 is associated with R2, S3 is associated with R3, and so on. If switch S5 is closed and the other switches remain open, current flows through R2, R3, R4 and R5 (which are effectively in series when S5 is closed). In other words, the current passing through a resistive element may pass in series through each lower-numbered resistive element. In other embodiments, the number of and the coupling between the switches 240 and resistors 242 may differ.

As shown, one of the switches 240 may be implemented without a resistor associated with that switch. This may allow cost savings and/or improve compatibility of the accessory 200 with other electronic devices. In the embodiment as shown, switch S1 is implemented without a resistor 242. The switch without a resistor, generally, may be coupled to the PLAY/PAUSE button and/or for muting the microphone during phone conversations.

Each of the control buttons 210, 212, 214, 216, and 218 are mechanically coupled to a particular switch S1, S2, S3, S4 or S5 such that when the button is pressed or otherwise activated, the corresponding switch completes a circuit in the accessory 200, and the resistor associated with that switch, if any, affects the voltage of the circuit.

Figure 5:
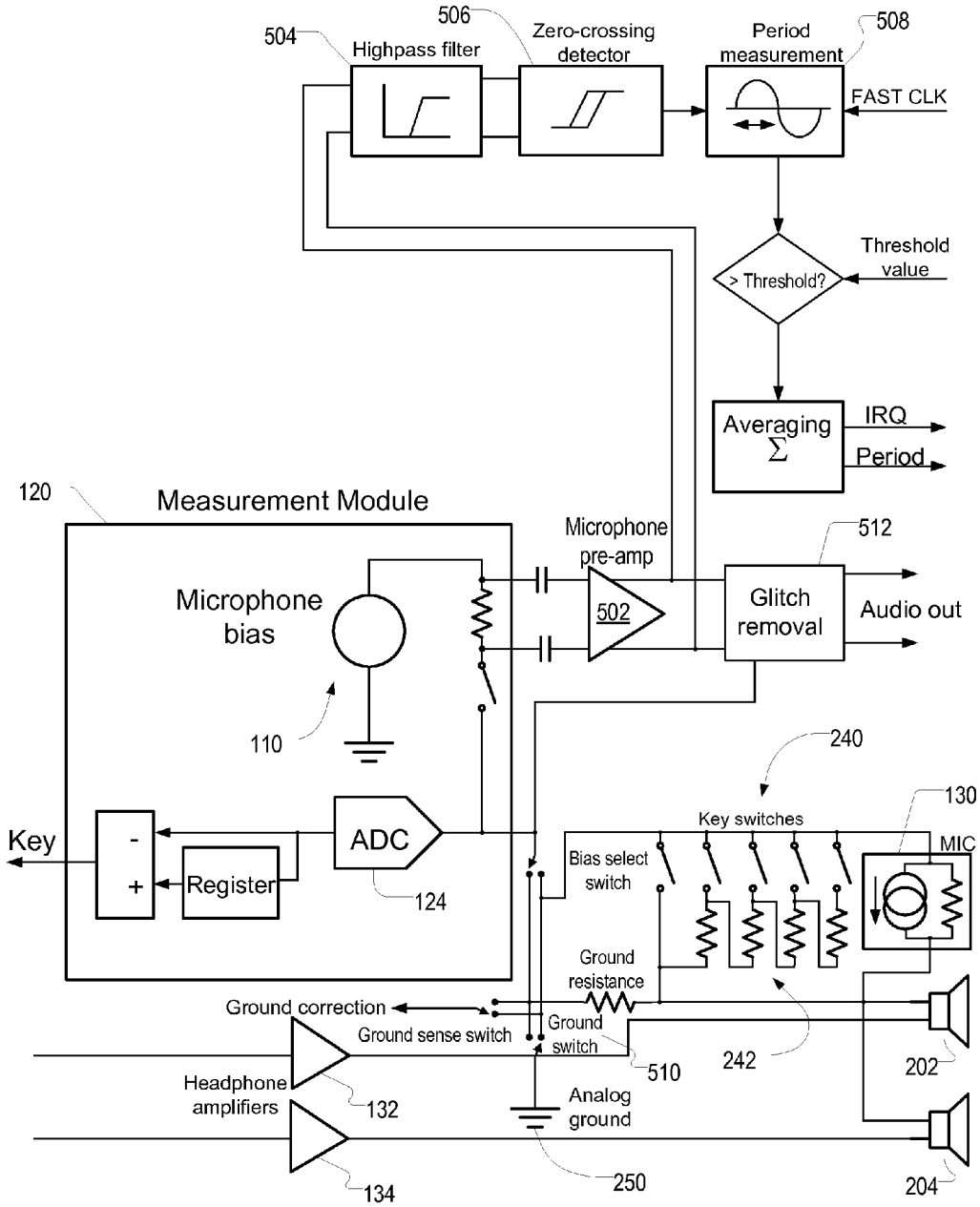
FIG. 5 is a block diagram of the components shown in FIG. 4 connected to additional components of the electronic device shown in FIG. 1 according to some embodiments.

The resistors and the switches may be configured in a "series" configuration as shown in FIG. 3, or in "parallel" configuration as shown in FIG. 4. The terms "series" and "parallel" are used herein to denote general circuit topology, and do not require that components be strictly in series or in parallel. (Note that a variant topology is shown in FIG. 5.) In general, the particular resistance values that may be selected for resistors 242 may be a function of the selected topology. In the circuit of FIG. 4, positive current approaching any switch from the left side of the circuit need not pass through any resistor 242, except the resistor (if any) associated with that switch. For example, current through S2 would pass through R2 (but not through any other resistor 242 as long as the other switches are open). Similarly, current through S3 would pass through R3 but no other resistor 242, and so on. In contrast to the "series" configuration of the circuit of FIG. 3, in which activation of a switch may cause current to flow through two or more resistors in series, the "parallel" configuration of FIG. 4 enables a current path through a single resistor regardless of which switch is closed. The "series" configuration automatically makes a priority encoding of the switches and makes any key buttons, including simultaneous presses of multiple buttons, result in a known resistance value (as may be readily found by elementary circuit analysis). For example, when multiple switches are engaged simultaneously, the switch associated with the lowest resistance value that is pressed will have the highest priority and be largely unaffected by any button presses associated with higher resistance values. This is due to the fact that a lower resistance path conducts more current than a higher resistance path.

The resistance value of each of the resistors R2, R3, R4, and R5 may be unique such that it is possible to identify which (if any) of the buttons have been pressed by measuring the differential voltage between the ground and the bias voltage connection and correction for the offset voltage on the connection to the ground.

As shown in FIGS. 3 and 4, the electronic device 100 has a measurement module 120. The measurement module 120 comprises a controller module 122 and a voltage measuring module, which may be an analog-to-digital converter (ADC) 124. In other embodiments the components of the measurement module 120 may differ.

In some embodiments, the electronic device 100 also has headset speaker amplifiers 132 and 134 coupled to the speakers 202 and 204 when the accessory 200 and electronic device 100 are mechanically and electrically coupled (e.g., via proper insertion of the plug into the jack). The headset speaker amplifiers 132 and 134 may amplify the incoming audio output and send audio currents to the speakers 202 and 204 on the accessory 200 such that the speakers 202 and 204 can provide the audio output. Generally, a circuit on the audio accessory 200 that receives the audio current and routes the audio current through the speakers 202, 204 to the ground 250 may be referred to as the "audio circuit". In some embodiments, the headset accessory 200 also includes electromagnetic interference filtering components and/or components to protect against electrostatic discharge.

The electronic device 100 also has a bias voltage source for providing power to the switches via a bias resistor and a ground connection. As shown, the bias voltage source 110 may be the microphone bias voltage source 110 for providing a bias voltage to the switches 240 and the microphone 230 via a microphone bias resistor "RM" and a ground connection, generally indicated by reference letter "G", connected to the ground 250. Generally, a circuit on the audio accessory 200 that receives the microphone bias current and routes the microphone bias current through the ground connection to the ground 250 and the resistors 242 may be referred to as the "microphone circuit".

Note that even though the term "microphone bias" is generally used in conjunction with electret microphones, this biasing voltage need not be used to bias the microphone plates which have an inherent internal electric field trapped between the plates due to the construction, but rather to ensure that the integrated JFET has a correct operating point. Signal from the microphone is obtained from this point and referenced either to the ground potential or to the microphone bias source 110.

The microphone 230 and the resistors 242 are connected via the ground connection "G" to the ground 250. The ground connection "G" has a finite amount of ground resistance, which in the figures is modelled as ground resistance "RG" (which is not necessarily an actual resistor). As the ground connection "G" has a finite amount of resistance, any current transmitted through the ground connection induces a ground offset voltage. For example, a current of 30 mA on the ground connection "G" and a ground resistance "RG" of 0.50hm will induce a ground offset voltage of 15 mV on the ground connection, which is connected to the switches 240.

The audio current associated with audio output to speakers 202 are conducted through the ground connection "G" to the ground 250, as such, the audio output will cause a ground offset voltage on the ground connection.

Similarly, as the microphone bias voltage is conducted through the ground connection, the microphone bias voltage also causes a ground offset voltage on the ground connection. However, the current through the microphone is relatively negligible in comparison to the audio currents and can be ignored with respect to the ground offset, but not with respect to the differential voltage over the microphone.

The ground 250 is common to both the microphone circuit and audio circuit. In particular, both the microphone bias voltage source 110 and audio speakers 202, 204 are connected to the ground 250. As such, the ground offset voltage across the ground connection tends to be affected by the microphone bias voltage, the audio output and one or more resistive switches when those switches are engaged.

The voltage of the audio circuit tends to be time variant (i.e., may be of different values at any given time). For example, the voltage may vary with the music that is being played on the speakers 202, 204. Accordingly, the ground offset voltage, at point "A" along the ground connection "G" varies with time. In particular, current flowing through the speakers 202, 204 returning to the ground 250 will experience voltage drop due to the finite ground line resistance "RG", and accordingly the voltage at the measurement point "A" tends to vary with time Similarly, the microphone bias voltage may also be time variant, and contribute to the voltage variance along the ground connection "G". However, the variance in the microphone bias current can to some degree be compensated for by carefully selecting the resistors R1 to R5 and, in some embodiments, the microphone 230. Furthermore, by using the microphone bias voltage as a direct or scaled reference to the ADC 124 that is performing the measurement of voltage over the microphone 230 and the resistors, it is possible to reduce the effects of the uncertainty of the bias voltage. The measurements from the ADC 124 can be scaled with the bias voltage such that variations in the bias voltage are generally compensated for.

This variance (fluctuation) in voltage of the audio current and/or microphone bias current may limit the number of resistive switches that are implemented in other systems. That is, to account for the variance of the audio voltage, the differences of the resistance value of the resistors often are relatively large to account for the variances such that the changes in ground offset voltage due to the variances are not mistakenly attributed to one of the resistors associated with one the switches (which would result in incorrectly identifying that switch as being engaged). Since the maximum voltage of the circuit may be limited and the value of the resistor differences between resistors may be relatively large, the number of buttons that has normally been employed may also be limited (e.g., in some cases to no more than two or three switches).

However, the audio system 10 as described herein may compensate for the fluctuations in the voltage of the audio current such that a larger number of control buttons (e.g., five control buttons) can be practically used. Furthermore, the resistors may be carefully selected to allow margin for any variation in microphone current.

To account for the variations of the voltage of the audio circuit and identify which, if any, of the resistive switches have been engaged, the measurement module 120 on the device 100 is adapted to perform (i.e., is capable of performing) the following operations.

The measurement module 120 is adapted to monitor a bias point on a connection between the bias voltage source and the switches 240 to determine when at least one of the switches 240 has been engaged. For example, the monitoring could be performed at a bias point "B" by the ADC 124 on the connection between the microphone bias source 110 and the microphone 230 and switches 240. The ADC 124 may monitor for a specific threshold, selecting between when no switches 240 are engaged (i.e., only the microphone is connected) and when at least one of the switches 240 is engaged, which reduces the voltage over the microphone 230. In some embodiments, the threshold is a fixed voltage such as 0.64 Volt, in other embodiments, the threshold may vary with the bias voltage and bias resistor selected.

When it is determined that at least one of the switches 240 has been engaged, the measurement module 120 is operable to activate and deactivate the bias voltage source (e.g., by using the switch SM) and then take a first and second measurement of the voltage at the bias point "B". The first measurement is taken while the bias voltage source is activated and the second measurement is taken while the bias voltage source is deactivated.

The ADC 124 may be used to take both the first and second measurements at the bias point "B". Since the microphone bias point "B" is connected to the measurement point A (through the microphone and also through any switch that is being engaged), the voltage of the microphone bias point B will be virtually the same as the voltage at point A provided the input impedance of the ADC 124 is significantly higher than the impedance of the source. That is, in the system 10 as shown, the bias source 110 is either the microphone output impedance or configured in parallel with the resistors that is engaged, and since the relative ground offset error will be greatest for the smallest resistor values, the output impedance is generally low. As such, using an ADC with sufficiently high input impedance will not change the voltage measured appreciably. A typical requirement for the input impedance of this ADC will be an input impedance of at least 50 kOhm. Accordingly, the ADC 124 is operable to effectively measure the voltage at measurement point A by taking the measurement at the bias point B. Notice that the ground offset can be both positive or negative depending on the direction of current. Therefore, the ADC will need to be able to handle both negative and positive voltages or a small offset needs to be added to all measurements to ensure only positive values are measured.

As the switches 240, microphone 230, and the speakers 202, 204 are connected to a common ground 250, when the bias voltage source is activated and the first measurement is taken, the first measurement is indicative of the ground voltage offset caused by the audio output, bias voltage and resistance of the at least one switch 240 that is engaged. That is, the first measurement is indicative of the ground offset voltage across the ground connection "G" that is attributable to the audio current of the audio output and the bias current being conducted through the finite ground resistance "RG" and the resistance of the at least one switch 240 that is engaged.

In contrast, when the bias voltage source is deactivated and the second measurement is taken, the second measurement is indicative of the ground offset caused by the audio output. That is, the second measurement is indicative of the ground offset voltage attributable to the audio current being conducted through the ground connection having the ground resistance "RG" taken without the effect from the microphone bias voltage or the resistors 242 as there is no bias voltage to the ground 250 through the microphone 230 or resistors 242 (assuming that the ADC 124 has sufficiently high input impedance to avoid loading at this point).

The measurement module 120 is operable to determine a ground offset voltage caused by the audio output based on the second measurement, and compensate for the ground offset voltage caused by the audio output based on a voltage difference between the first and second measurements. That is, since the first measurement is affected by the voltage of the audio current, microphone bias voltage and resistance associated with the at least one switch that is engaged, and the second measurement is indicative of just the voltage of the audio current, the difference between the first and second measurement is indicative of the voltage difference as measured over the microphone and switch resistance. Based on this voltage difference, the measurement module 120 is operable to determine which of switches 240 has been engaged.

Since the magnitude of the audio current is time variant, the magnitude of the audio current taken at the first measurement may differ from the magnitude of the audio current taken at the second measurement. As such, the measurement module 120 is operable to take the measurements in rapid succession to minimize the difference (if there are any differences) of the voltage of the audio current. For example, the measurements may be taken a few microseconds apart.

In some embodiments, additional measurements may be taken with the bias source activated and/or deactivated to obtain a more accurate (robust) measurement of the audio voltage. For example, three measurements could be taken, firstly with the microphone bias activated, secondly with the microphone bias deactivated and thirdly with the microphone bias reactivated. To determine the ground offset attributable to the audio current in this case, the first and third measurements could be added together, and twice the second measurement value could be subtracted therefrom (i.e., (First Measurement+Third Measurement)−(2×Second Measurement)) to provide a more robust estimate of the ground offset voltage due to the audio current.

In another example, four measurements could be taken: first with the microphone bias source activated, the second and third with the microphone bias source deactivated, and the fourth with the microphone bias source reactivated. In this case, the ground offset voltage attributable to the audio output could be calculated as the sum of the first and fourth measurements minus the sum of the second and third measurements (i.e., First Measurement+Fourth Measurement−(Second Measurement+Third Measurement)). The summing of the values can either be done in the digital domain, i.e., weighting the measured ADC values or could be formed by sampling several values using switched capacitors and measuring the analog weighted sum of these samples using a single ADC reading. These methods effectively implement a discrete time lowpass filter that removes fluctuations in the measured offset voltage.

By minimizing and compensating for the effect of the audio currents on the ground connection "G", it is possible to use resistors with relatively lower resistance values as the variance of the audio offset voltage can now be accounted for. However, when selecting the resistance values, the variations in the microphone bias voltage should be considered. Additionally, the microphone 230 itself has an internal variance (e.g., due to JFET in the microphone) that needs to be taken into account when selecting resistor values.

Generally, variations in the ground offset voltage may be caused by one or more of the following factors: number of switches that are simultaneously engaged, variance in operating environment (e.g., temperature), variance in absolute resistance of the JFET in the microphone 230 between DRAIN and SOURCE (e.g., a result of production variations), variance in the actual resistance of the resistors, and other noise-inducing factors (e.g., accuracy of the ADC reading, external noise, problems with subtracting a time varying ground offset signal, etc.).

The resistor values may be selected to account for one or more of the variances as follows.

Since number of resistance values encountered from the switches is equal to the number of switches plus one using the "series" combination (the extra case is when no switch is pressed and the resistance of the microphone itself is measured), the requirement for non-overlapping resistor measurements can be formulated as follows: $R_N(MAX)<R_{N+1}(MIN)$, where $R_N$ is a given resistor value and $R_{N+1}$ is the next higher resistor value.

The maximum resistor value can be found as the nominal value of $R_N$ plus the maximum tolerance due to production and environmental variations in "parallel" with the largest possible value of the JFET (i.e., $JFET_{MAX}$). The minimum resistor value can be found as the nominal value of $R_{N+1}$ minus the maximum tolerance due to production and environmental variations in parallel with the lowest possible value of the JFET (i.e., $JFET_{MIN}$). In order to get a more robust implementation, the allowed tolerances should be distributed equally across all resistors. This requirement can be formulated as follows: $R_N(MAX)*(1+TOLERANCE)=R_{N+1}(MIN)$, where "tolerance" is the tolerance allocated for system errors and noise. Typically, the required tolerance is 10-15%. However, the 2-3 lowest resistors needs extra tolerance, since they will be more susceptible to external electric noise due to a smaller measured voltage difference than the highest value ones. Based on this, the resistors values can be determined, for example by using computer optimization.

As to the variation induced by JFET in the microphone 230, it is possible to determine the extreme values of the resistance between DRAIN and SOURCE on the JFET as a result of production, bias point and temperature. In some embodiments, the resistance attributable to the JFET at extremes are determined to be $JFET_{MIN}$=475 Ohm and $JFET_{MAX}$=20 kOhms.

In some embodiments the association of the control switches and the detected resistance values could be as shown in Table 1. The R(MIN) and R(MAX) values shown indicate the minimum and maximum resistance value that will cause the electronic device to detect that the associated switch has been engaged.

TABLE 1

Determination of switch based on measured resistor value.

| | R(MIN) | R(MAX) | UNIT | FUNCTION |
|---|---|---|---|---|
| S1 | 0 | 14 | Ω | PLAY/PAUSE |
| S2 | 14 | 37 | Ω | +VOLUME |
| S1 | 37 | 57 | Ω | PLAY/PAUSE |
| S4 | 57 | 96 | Ω | −VOLUME |
| S5 | 96 | 172 | Ω | >> FORWARD |
| S6 | 172 | 405 | Ω | << REWIND |

As shown in the Table 1, if the drop in ground offset voltage is between 0Ω and 14Ω or 37Ω and 57Ω, the electronic device is configured to regard this as switch S1 has been pressed. Having two ranges of resistance values associated with a given switch S1 may allow the portable device to be compatible with audio headsets with different configurations.

In some embodiments, any resistance value below the minimum JFET value will be mapped to the PLAY/PAUSE/MUTE function if the ground connection is found to located at the SLEEVE position. This will ensure that any additional resistance will not affect PLAY/PAUSE/MUTE for these headsets.

In the embodiment as shown, the controller module 122 is operable to control the ADC 124 and operation of the microphone bias source 110. In other embodiments, the measurement module 120 may include a programmable processor adapted to execute the operations described above.

In some embodiments the measurement module 120 and/or other components of the electrical device 100 is operable to perform one or more of the steps of the method 300 for determining which of the plurality of switches 240 in an audio accessory 200 is engaged.

Referring now to FIG. 5, illustrated therein are additional components that may be found on the electronic device 100. Some of the components illustrated in FIG. 5 may be similar to or the same as those of FIG. 5, and where appropriate like components are indicated by like reference numerals.

In some embodiments, the output from the microphone bias resistor "RM" may be taken as input to a microphone pre-amplifier 502, in order to decrease the influence from noise from the bias source 110 or other noise sources (or both).

In some embodiments, as shown in FIG. 5, the output from the microphone pre-amplifier 502 may be highpass filtered (e.g., using a highpass filter module 504) in order to decrease the amplitude of any audio signal, and passed through a zero-crossing detector 506 and output from the detector 506 to a period measurement module 508 (for e.g. a digital circuit that is able to measure period of an out-of-band signal). This may be used to receive out-of-band control signals in other configurations.

In some embodiments, as shown in FIG. 5, the ground signal measured after the ground switch 510 is used as a correction signal for the headphone amplifiers 132 and 134 to correct for any ground offset and thereby reduce crosstalk between these two channels.

In some embodiments, as shown in FIG. 5, an optional glitch reducing circuit 512 is added after the microphone pre-amplifier. This circuit will disable the microphone pre-amplifier during key press and output a DC-potential equal to the value just before the key press to minimize the audible impact at the receiving end when pressing a key. This can be implemented by detecting the DC-potential at the microphone bias point and if this potential is sufficiently low (i.e., a key is pressed), activating the glitch reducing circuit 512.

The glitch reducing circuit 512 may be implemented using a filter with a low cut-off frequency (e.g., implemented with a switch capacitor filter) and a sample and hold circuit that sense the output from the pre-amplifier 502 and make sure the microphone output signal is switched from the output of the pre-amplifier 502 to the steady DC value. This will result in a significant reduction of the audible glitch experienced at the receiving end when one of the buttons 208 is pressed.

Figure 6:
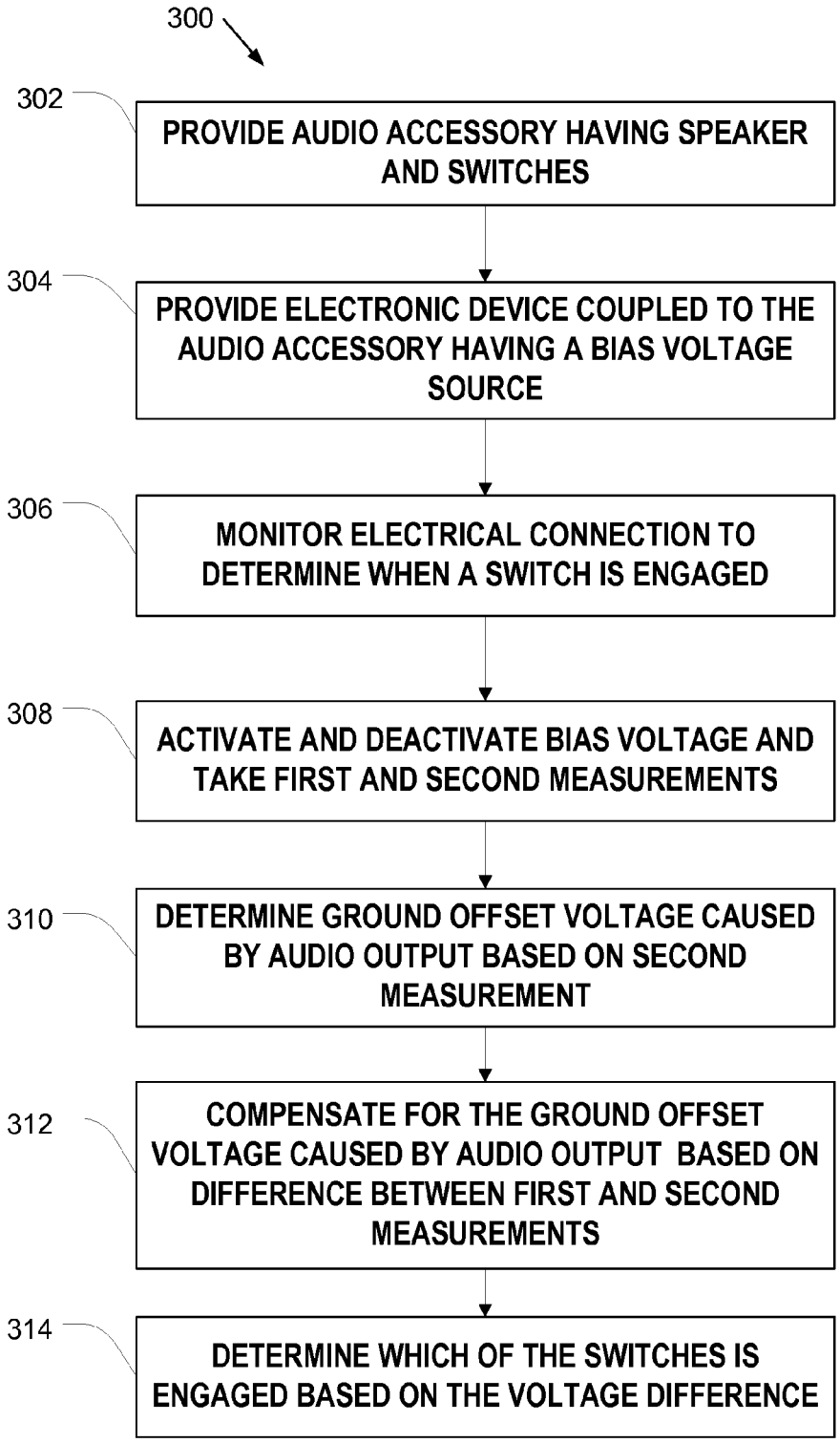
FIG. 6 is a block diagram of steps of a method for determining which of a plurality of switches in an audio accessory is engaged to one embodiment.

Referring now to FIG. 6, illustrated therein is a block diagram of steps of a method 300 for determining which of a plurality of switches in an audio accessory is engaged according to one embodiment.

At step 302, the audio accessory having at least one speaker for providing audio output and a plurality of resistive switches is provided. Each of the switches has a selected resistance. In some embodiments, the audio accessory may be the audio accessory 200 as described above.

At step 304, an electronic device coupled to the audio accessory having a bias voltage source for providing power to the resistive switches via a bias resistor and a ground connection is provided. In some embodiments, the electronic device may be the electronic device 100 as described above.

At step 306, the bias point on a connection between the bias voltage source and the resistive switches is monitored to determine when at least one of the switches has been engaged.

At step 308, at least once while that switch is engaged, the bias voltage source is activated and deactivated and a first and second measurement of the voltage difference between the microphone bias point and the ground connection are taken. The first measurement is taken while the bias voltage source is activated and the second measurement is taken while the bias voltage source is deactivated or vice-versa.

In some embodiments, the first and second measurements are taken a rapid succession (for e.g., a few microseconds apart) such that a variation of the audio voltage between the measurements is inconsequential to the determination the audio voltage.

In some embodiments, one or more additional measurements of the voltage difference between the microphone bias and the ground connection while the bias voltage is activated or deactivated are taken after the first and second measurements, and the additional measurements are used to provide a more accurate measurement of the ground voltage offset due to the audio current. The additional measurements may provide a more robust measurement of the ground voltage offset when the fluctuations of the audio currents vary quickly.

At step 310, ground offset voltage caused by the audio output is determined.

At step 312, the ground offset voltage caused by the audio output is compensated for based on a voltage difference between the first and second measurements.

At step 314, which of the switches has been engaged based on the voltage difference is determined in step 312.

Generally, it is advantageous for the operations of the method 300 to be implemented on the electronic device. That is, it is not necessary to include a measurement module or other components necessary to execute the method 300 on the audio accessory separately if the method is being executed on the electronic device.

Generally, it is more cost efficient to implement the measurement module operable to execute one or more steps of method 300 as part of a specialized headset interface chip or as part of a CODEC chip that already controls the headset jack. As such, the method may be implemented using hardware components already existing on some portable electronic devices such that there are no additional hardware components necessary.

Implementation of one or more embodiments may realize one or more advantages, some of which have already been mentioned: lightweight, low cost, robust, flexible in implementation, supporting enhanced functionality, and so on. While the above description provides examples of one or more apparatus, methods, or systems, it will be appreciated that other apparatus, methods, or systems may be within the scope of the present description as interpreted by one of skill in the art.

The invention claimed is:

1. A system adapted to control an electronic device, the system comprising:

an audio accessory coupled to the electronic device, the audio accessory having at least one speaker adapted to provide audio output and a plurality of resistive switches, each switch having a selected resistance; and the electronic device having a bias voltage source adapted to provide power to the resistive switches via a bias resistor and a ground connection, and a measurement module adapted to:

(a) monitor a bias point on a connection between the bias voltage source and the resistive switches to determine when at least one of the switches has been engaged, (b) at least once while that switch is engaged, activate and deactivate the bias voltage source, taking a first measurement of the bias point while the bias voltage source is activated and a second measurement of the bias point while the bias voltage source is deactivated, (c) determine a ground offset voltage caused by the audio output based on the second measurement, (d) compensate for the ground offset voltage caused by the audio output based on a voltage difference between the first and second measurements, and (e) determine which of the switches has been engaged based on the voltage difference.

2. The system of claim 1, wherein the audio accessory further comprises a microphone for receiving audio input coupled to the bias voltage source and the resistive switches, and wherein the bias resistor is a microphone bias resistor.

3. The system of claim 1, wherein the switches, bias voltage source and the at least one audio speaker are connected to a common ground connection such that when the bias voltage source is activated and the first measurement is taken, the first measurement is indicative of the ground voltage offset caused by the audio output, bias voltage and resistance of the at least one switch that is engaged, and when the bias voltage source is deactivated and the second measurement is taken, the second measurement is indicative of the ground offset caused by the audio output.

4. The system of claim 1, wherein the resistance value associated with each of the switches is unique such that the measurement module is operable to determine whether at least one of the plurality of switches is engaged, and if at least one of the switches is engaged, an identity of the at least one switch that is engaged by analyzing the ground offset voltage caused by the bias voltage and the resistor of the at least one switch that is engaged.

5. The system of claim 2, wherein the resistance value associated with each of the switches in the audio accessory is selected to account for variations in the ground offset voltage caused by at least one of: the microphone; microphone bias voltage; and an operating environment of the audio accessory.

6. The system of claim 5, wherein the plurality of switches comprises at least five resistive switches, each resistive switch comprising a resistive element having a resistance value, the five resistive switches including:

a first switch having a first resistive element with a resistance value of between 0 and 2 Ohms, a second switch having a second resistive element with a resistance value between 27 and 32 Ohms, a third switch having a third resistive element with a resistance value between 45 and 50 Ohms, a fourth switch having a fourth resistive element with a resistance value between 69 and 73 Ohms, and a fifth switch having a fifth resistive element with a resistance value between 172 and 176 Ohms; and wherein the resistive elements of the resistive switches are connected in series to enable current passing through any resistive switch to pass in series through the resistive elements associated with that switch and any preceding resistive element.

7. The system of claim 5, wherein the plurality of switches comprises at least five resistive switches connected in parallel, each resistive switch comprising a resistive element having a resistance value the five resistive switches including: a first switch having a first resistive element with a resistance value of between 0 and 2 Ohms, a second switch having a second resistive element with a resistance value between 27 and 32 Ohms, a third switch having a third resistive element with a resistance value between 75 and 79 Ohms, a fourth switch having a fourth resistive element with a resistance value between 146 and 150 Ohms, and a fifth switch having a fifth resistive element with a resistance value between 320 and 324 Ohms.

8. The system of claim 2 wherein the audio accessory is a stereo headphone having a microphone and a plurality of control buttons mechanically coupled to the plurality of switches, the control buttons being operable to engage the switches to indicate to the electronic device to perform selected functions.

9. The system of claim 2, wherein an output of the microphone is obtained by measuring a differential voltage over the microphone bias resistor.

10. The system of claim 2, wherein output from the microphone is highpass filtered and detected period after passing a zero-crossing detector with a finite hysteresis to enable period detection of out-of-band control signalling components.

11. The system of claim 2, wherein the electronic device further comprises a feedback loop between the ground and at least one headphone amplifier on the electronic device to reduce crosstalk and noise in the audio output.

12. The system of claim 2, further comprising electromagnetic interference and electrostatic discharge components for safety and system integration.

13. The system of claim 2, wherein the electronic device further comprises a glitch removal circuit on the electronic device adapted to attenuate audible effects of the key press by forcing the output from the microphone pre-amplifier to a known state before the key press.

14. The system of claim 1, wherein the electronic device comprises an audio connection port, and the audio accessory comprises an audio connector adapted to connect to the electronic device via the connection port.

15. The system of claim 14, wherein the connection port on the electronic device is able to switch the ground connection between a "RING 2" position and a "SLEEVE" position such that the electronic device is able to receive the audio accessory having the audio connector with the ground connection at least one of the "RING 2" position and the "SLEEVE" position.

16. The system of claim 1, wherein the first and second measurements are taken in rapid succession such that a variation of the ground offset between the measurements is reduced.

17. The system of claim 1, wherein the measurement module is adapted to take the first and second measurements at less than ten microseconds apart.

18. An audio accessory comprising at least one speaker adapted to provide audio output and a plurality of resistive switches, each switch having a resistive element having a resistance, the audio accessory being coupleable to an electronic device having a bias voltage source adapted to provide power to the resistive switches via an bias resistor, and a measurement module, and when the audio accessory is coupled to the electronic device, the measurement module is adapted to:

monitor a bias point on a connection between the bias voltage source and the resistive switches to determine when at least one of the switches has been engaged;

at least once while that switch is engaged, activate and deactivate the bias voltage source, taking a first measurement of the bias point while the bias voltage source is activated and a second measurement of the bias point while the bias voltage source is deactivated;

determine a ground offset voltage caused by the audio output based on the second measurement; compensate for the ground offset voltage caused by the audio output voltage based on a voltage difference between the first and second measurements; and determine which of the switches has been engaged based on the voltage difference.

19. An electronic device coupleable to an audio accessory having at least one speaker adapted to provide audio output and a plurality of resistive switches, each switch having a resistive element having a resistance, the electronic device comprising:

a bias voltage source adapted to provide power to the resistive switches via a bias resistor when the electronic device is coupled to the audio accessory; and a measurement module adapted to:

(a) monitor a bias point on a connection between the bias voltage source and the resistive switches to determine when at least one of the switches has been engaged;

(b) at least once while that switch is engaged, activate and deactivate the bias voltage source, taking a first measurement of the bias point while the bias voltage source is activated and a second measurement of the bias point while the bias voltage source is deactivated, (c) determine a ground offset voltage caused by the audio output based on the second measurement, (d) compensate for the ground offset voltage caused by the audio output by determining a voltage difference between the first and second measurements, and (e) determine which of the switches has been engaged based on the voltage difference.

20. A method for determining which of a plurality of switches in an audio accessory is engaged comprising: providing the audio accessory having at least one speaker adapted to provide audio output and a plurality of resistive switches, each switch having a selected resistance;

providing an electronic device coupled to the audio accessory having a bias voltage source adapted to provide power to the resistive switches via a microphone bias resistor and a ground connection;

monitoring a bias point on a connection between the bias voltage source and the switches to determine when at least one of the switches has been engaged;

at least once while that switch is engaged, activating and deactivating the bias voltage source and taking a first measurement of the bias point while the microphone bias voltage source is activated and a second measurement of the bias point while the microphone bias voltage source is deactivated;

determining a ground offset caused by the audio output;

compensating for the ground offset caused by the audio output based on a voltage difference between the first and second measurements; and determining which of the switches has been engaged based on the voltage difference.

* * * * *